US011142955B2

(12) United States Patent
Downton

(10) Patent No.: US 11,142,955 B2
(45) **Date of Patent: *Oct. 12, 2021**

(54) STEERABLE DRILL BIT SYSTEM

(71) Applicant: Schlumberger Technology Corporation, Sugar Land, TX (US)

(72) Inventor: Geoffrey Downton, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/808,580

(22) Filed: Mar. 4, 2020

(65) Prior Publication Data

US 2020/0199942 A1 Jun. 25, 2020

Related U.S. Application Data

(63) Continuation of application No. 14/957,781, filed on Dec. 3, 2015, now Pat. No. 10,605,005.

(60) Provisional application No. 62/089,772, filed on Dec. 9, 2014.

(51) Int. Cl.

| | |
|---|---|
| ***E21B 7/06*** | (2006.01) |
| ***E21B 44/00*** | (2006.01) |
| ***E21B 47/024*** | (2006.01) |
| ***E21B 47/18*** | (2012.01) |

(52) U.S. Cl.

CPC ..... *E21B 7/064* (2013.01); *E21B 44/005* (2013.01); *E21B 47/024* (2013.01); *E21B 47/18* (2013.01)

(58) Field of Classification Search

CPC ..... E21B 7/064; E21B 44/005; E21B 47/024; E21B 47/18

See application file for complete search history.

(56) References Cited

U.S. PATENT DOCUMENTS

| | | | | |
|---|---|---|---|---|
| 2004/0173381 | A1 | 9/2004 | Moore et al. | |
| 2007/0247328 | A1 | 10/2007 | Petrovic et al. | |
| 2008/0000693 | A1 | 1/2008 | Hutton | |
| 2009/0090501 | A1* | 4/2009 | Hansen | E21B 34/066 166/72 |
| 2010/0006341 | A1 | 1/2010 | Downton | |
| 2011/0226470 | A1 | 9/2011 | Latrille et al. | |
| 2012/0132428 | A1 | 5/2012 | Polyntsev | |
| 2012/0145458 | A1 | 6/2012 | Downton | |
| 2012/0234606 | A1 | 9/2012 | Hall et al. | |
| 2013/0092441 | A1 | 4/2013 | Hummes et al. | |
| 2014/0138084 | A1* | 5/2014 | Al-Mulhem | E21B 17/1021 166/255.1 |

(Continued)

FOREIGN PATENT DOCUMENTS

WO 2007134748 A1 11/2007

OTHER PUBLICATIONS

International Search Report issued in PCT application PCT/US2015/064154 dated Mar. 18, 2016, 4 pages.

(Continued)

*Primary Examiner* — Taras P Bemko
*Assistant Examiner* — Yanick A Akaragwe

(57) ABSTRACT

A steerable drilling system in accordance to an embodiment includes a bias unit integrated with the drill bit to form a steering head and an electronic control system located remote from the steering head and electrically connected to a digital valve of the bias unit.

20 Claims, 2 Drawing Sheets

(56) References Cited

U.S. PATENT DOCUMENTS

| | | | | |
|---|---|---|---|---|
| 2014/0262507 | A1 | 9/2014 | Marson et al. | |
| 2016/0130878 | A1* | 5/2016 | Cobern | E21B 47/024 175/25 |
| 2016/0160567 | A1 | 6/2016 | Downton | |

OTHER PUBLICATIONS

Written Opinion issued in PCT application PCT/US2015/064154 dated Mar. 18, 2016, 11 pages.

* cited by examiner

STEERABLE DRILL BIT SYSTEM

CROSS-REFERENCE TO RELATED APPLICATIONS

This application is a continuation of U.S. application Ser. No. 14/957,781, filed on Dec. 3, 2015, which claims priority to U.S. Provisional Application No. 62/089,772, filed on Dec. 9, 2014, the entire contents of which are hereby incorporated by reference herein.

BACKGROUND

This section provides background information to facilitate a better understanding of the various aspects of the disclosure. It should be understood that the statements in this section of this document are to be read in this light, and not as admissions of prior art.

Oil and gas reservoirs may be accessed by drilling wellbores to enable production of hydrocarbon fluid, e.g. oil and/or gas, to a surface location. In many environments, directional drilling techniques have been employed to gain better access to the desired reservoirs by forming deviated wellbores as opposed to traditional vertical wellbores. Forming deviated wellbore sections can be difficult and requires directional control over the orientation of the drill bit used to drill the deviated wellbore.

Rotary steerable drilling systems have been used to drill deviated wellbore sections while enabling control over the drilling directions. Such drilling systems often are classified as push-the-bit systems or point-the-bit systems and allow an operator to change the orientation of the drill bit and thus the direction of the wellbore. In conventional rotary steerable drilling systems, the drill bit section or housing is connected to a steering control section or housing by a field separable connection, such as a standard API (American Petroleum Institute) connection.

SUMMARY

This summary is provided to introduce a selection of concepts that are further described below in the detailed description. This summary is not intended to identify key or essential features of the claimed subject matter, nor is it intended to be used as an aid in limiting the scope of claimed subject matter.

In accordance to an embodiment a steering head for connecting to a drill string includes an intermediate section comprising two or more steering actuators in operation moveable in a radial direction to provide steering inputs, a first section comprising a digital valve to control flow of pressurized fluid to individual steering actuators of the two or more steering actuators, and a distal section comprising a formation cutting structure, the intermediate section positioned between the first section and the distal section. A steerable drilling system in accordance to an embodiment includes a steering head having a cutting structure, a steering actuator and a digital valve that is operational to port pressurized fluid to the steering actuator, and a control source electrically connected to the digital valve to operate the digital valve. A method in accordance to an embodiment includes utilizing a drill bit having a digital valves and steering actuators to propagate a borehole in a desired direction and applying functionality of one or more of a drilling mechanics module (DMM) and measurement while drilling (MWD) system to control a force and timing of the steering actuators to achieve the desired direction (i.e., meet the borehole propagation).

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
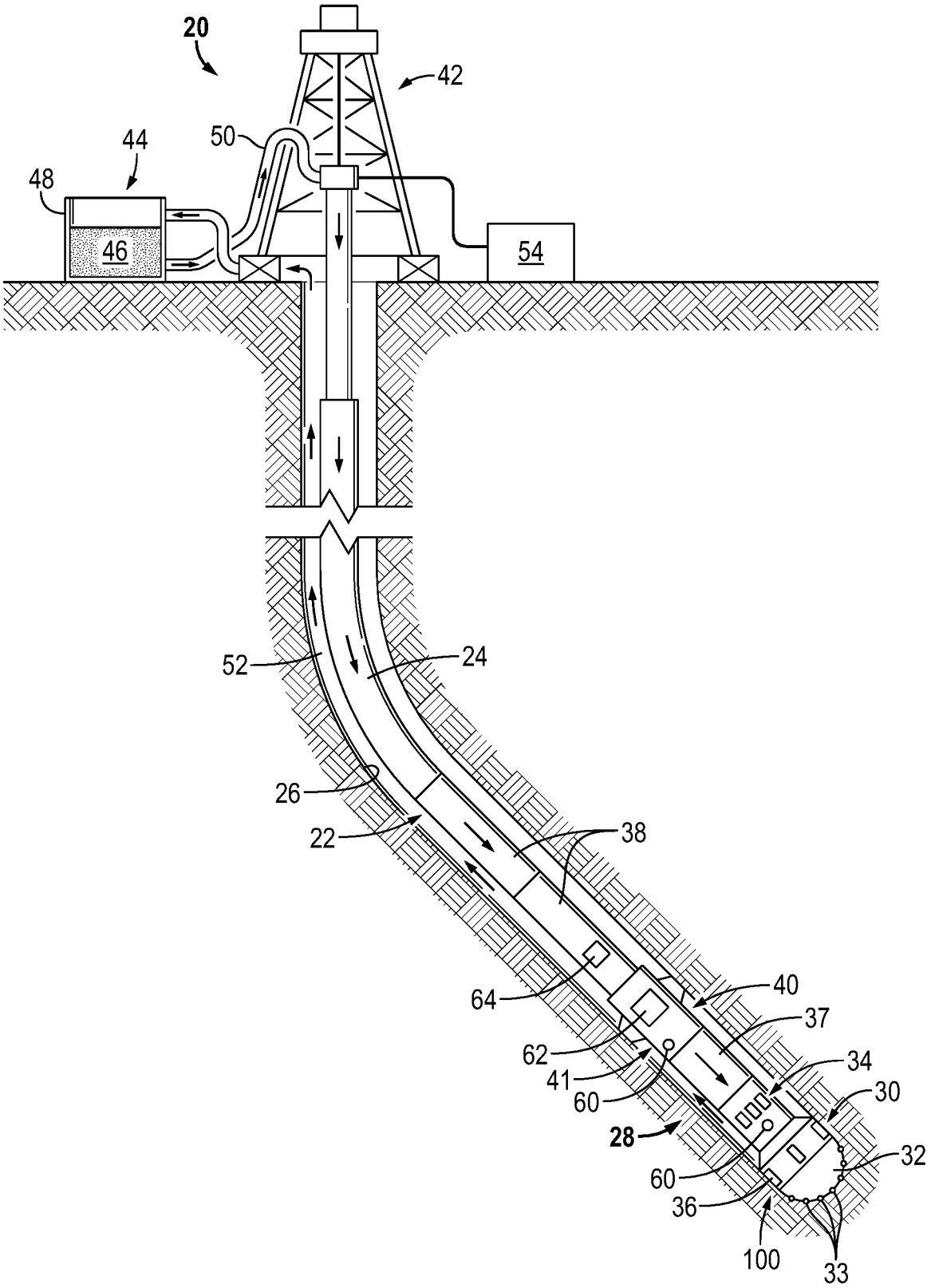
FIG. 1 is a schematic illustration of a drill string and drilling system incorporating a steerable drill bit in accordance to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

A steerable drilling system 20 in accordance to an embodiment includes steering actuators 36 integrated with a drill bit 32 and digital valves 34 integrated with the drill bit and operational to selectively port pressurized fluid to the steering actuators. Electrical power 64 and/or the timing control source 62 (i.e., processor) are electrically connected to the digital valves and can be located remote from the drill bit. In accordance to some embodiments, the timing control source is provided by a measurement while drilling (MWD) system 40, for example and without limitation, Schlumberger's TeleScope™, PowerPulse™, or ImPulse™ MWD systems. In accordance to one or more embodiments the control source is provided by drilling dynamics module (DMM) 41, e.g., Schlumberger's OptiDrill™ system. The DMM may include for example drilling mechanics and dynamics sensors and a processor. As will be understood by those with benefit of this disclosure, other control unit sources may be utilized and electrically connected to the bias unit of the steering system. Electrical power may be provided to the bias unit at the drill bit for example from an onboard electrical source located with the MWD system or the DMM, or from another electrical source (e.g., battery, turbine, etc.).

Referring generally to FIGS. 1-4, a drilling system 20 is illustrated as having a bottom hole assembly (BHA) 22 which is part of a drill string 24 used to form a desired, directionally drilled wellbore 26. The illustrated drilling system 20 comprises a steerable drilling system 28, e.g. a rotary steerable system (RSS), generally including a bias unit 30 that is integrated with the drill bit 32 body to form a steering head 100 and an electronic steering control unit or system (e.g., processor, memory, etc.) generally denoted by the numeral 62 operationally connected to the bias unit. Bias unit 30 includes control valves 34 (e.g., electrically operated digital valves) for directing drilling fluid 46 to respective steering actuators 36, e.g., pistons and pads. The steering actuators 36 are moved from their retracted positions toward their extended positions in response to receiving the drilling fluid. Return movement of the steering actuators to the retracted position can occur as the drilling fluid supply to the actuator is stopped and the drilling fluid escapes to the annulus, for example via small diameter leakage pathways. The supply of drilling fluid 46 to the steering actuators 36 is controlled by the digital control valves, the operation of which is controlled by the steering control unit using information derived from, for example, inclination and azimuth sensors, e.g., accelerometers, inclinometers, magnetometers and rate gyros. A single digital valve 34 can drive one or two actuators 36 as the digital valve has two positions. For example, in a first position a digital valve 34 can energize a first actuator and close a second actuator and vice versa in the second position or state of the digital valve.

Electrical power is provided to the control system 62 and the bias unit 30 from an electrical source 64, such as batteries and/or a mud driven turbine. The control system 62 may be in communication and designed to interact with sensors 60 to sense various parameters including without limitation the toolface direction and thus the direction the wellbore is being propagated. The steering control system may be constructed as a closed loop control for closing the control loop between the directional measurements received from sensors and steering actuator output via the steering actuators. The sensors 60 may be located in various locations in the drill string or bottom hole assembly. In accordance to some embodiments, sensors 60 may be incorporated into the steering head 100 (e.g., the integral drill bit), for example accelerometers, inclinometers, rate gyros, borehole-caliper and magnetometers. In accordance to some embodiments, the sensors 60 are incorporated in the MWD module, the DMM, and/or other systems (e.g., logging while drilling module, formation evaluation tools).

In accordance to at least one embodiment the steering actuators 36 are positioned in or on the bit body 32 with the formation cutting elements 33 and the control valve(s) 34 are disposed with and/or in the drill bit body. In accordance to at least one embodiment, the steering actuators 36 are positioned with the bit body and the control valves 34 are disposed for example in a sub immediately adjacent to the bit body 32. In accordance to at least one embodiment the formation cutting elements 33 or structure, the steering actuators 36 (e.g., a ring of actuators), and control valves 34 are separate structures that can be assembled to form the steerable drill bit, i.e., steering head 100. For example, the steering head may be assembled at the drilling rig or at a location remote from the drilling rig.

Figure 2:
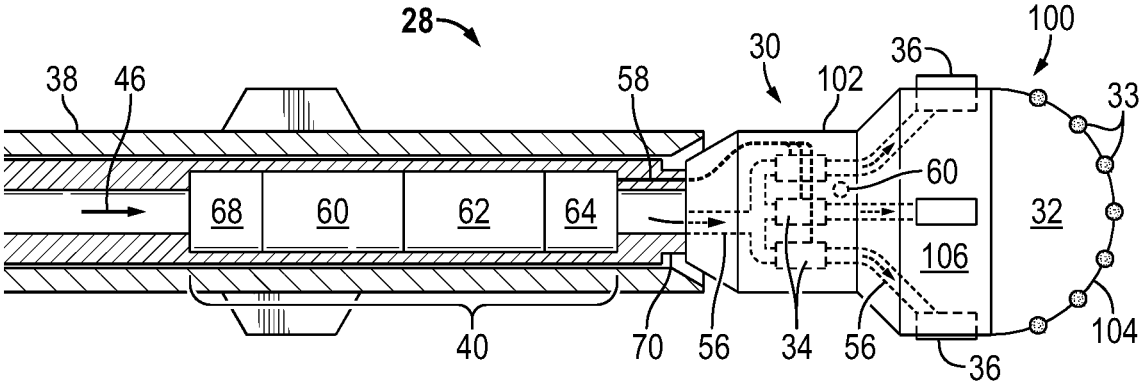
FIG. 2 is a schematic view of a steerable drill bit in operational connection with a measurement while drilling system in accordance to one or more aspects of the disclosure.
Figure 3:
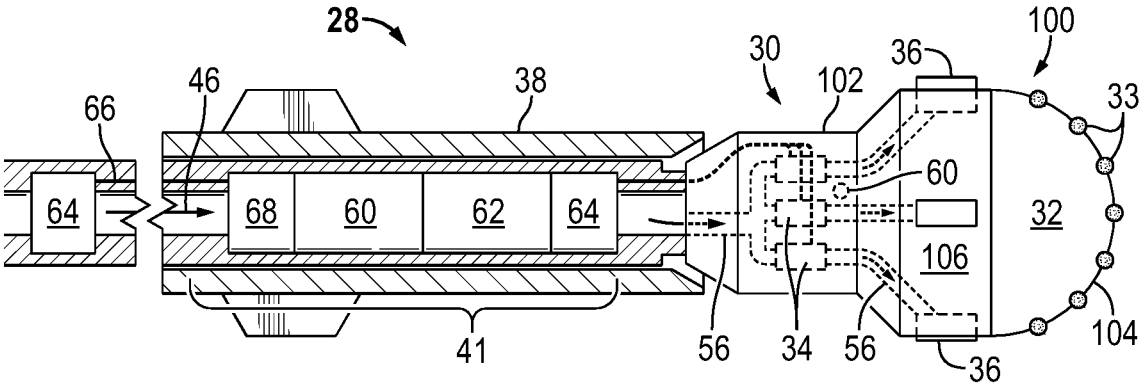
FIG. 3 is a schematic view of a steerable drill bit assembly in operational connection with a drilling dynamics module in accordance to one or more aspects of the disclosure.
Figure 4:
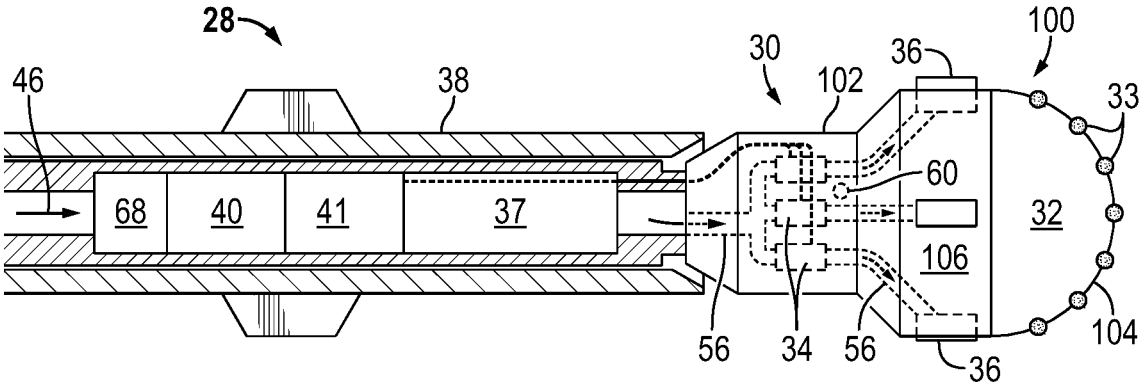
FIG. 4 is a schematic view of steerable bit separated from a downhole control unit by a drilling motor.

Integrated with the drill bit 32 includes being located with the drill bit body 32 or in a sub positioned between the drill bit body 32 and the collar 38, to form the steering head 100. For example, the steering head 100 is connected to the drill string 24 via a bit shaft 70 (FIGS. 2-4) disposed with a collar 38. With reference in particular to FIGS. 2-4, the integrated steering head 100 includes a first or proximate section 102, carrying the digital control valves 34, that is adjacent to the collar 38, a distal end section 104 carrying the cutting elements or structures 33, and an intermediate section 106 carrying the steering actuators 36. The drill bit body 32 forms at least the distal end 104, which carry some or all of the cutting elements 33. The proximate and intermediate sections 102, 106 may be portions of a unitary drill bit body 32 or be structures connected to the drill bit body 32. One or more of the sections 102, 104, and 106 may rotate independent of the other sections, for example provided that the bit cutting structure is driven by rotation of the bit shaft 70, i.e., either the collar 38 or a motor drive rotating shaft 70. A single actuator 36 could be used to steer if it is rotated with the cutting structure, however, in the case where the actuators are allowed to rotate independent of the cutting structure the system would utilize three actuators and at least two digital valves with four possible positions or states.

In accordance with one or more embodiments, the steering actuators 36 are capable of independent rotation with respect to the cutting structures 33. For example, the intermediate section 106 can rotate independent of the rotation of the distal end section 104 carrying the cutting structures 33. In accordance to one or more embodiments, the digital valves 34, i.e. proximate section 102, rotate with the steering actuators 36, i.e. the intermediate section 106. A rotary electrical connection may be made between the digital valves 34 and the MWD 40 and/or DMM 41 systems. Real time measurements may be obtained of the actuator positions relative to the MWD and/or DMM for example utilizing the on-bit sensors 60 which may be rotating with the actuator section or fixed with the bit.

Depending on the environment and the operational parameters of the drilling job, drilling system 20 may comprise a variety of other features. In accordance to embodiments, the bottom hole assembly 22 includes a measurement-while-drilling (MWD) module 40. As will be understood with benefit of this disclosure, in accordance to some embodiments the electrical systems of the MWD module 40 are electrically connected to the control valves 34 (e.g., digital valves) to supply the timing control signals to the control valves 34 and actuators 36. In some embodiments, the drilling system 20 includes a drilling mechanics module 41 (DMM). In accordance to some embodiments supplies timing control signals to the control valves 34. The electrical power source 64 and the control system 62 are in operational and electrical connection with the bias unit 30. Operational and electrical connection can be provided in various manners.

In accordance to one or more embodiments, the steering system may include a drilling mud motor 37. For example, in FIG. 1, the DMM and MWD are separated from the bias unit 30 and steering head 100 by the drilling mud motor. To communicate past the mud motor, electromagnetic wave transmission system may be utilized. Power and communications may be passed through or across the mud motor using wires. Due to the rotation, orbital and axial motion of the mud motor rotor with the drill collar slip rings may be utilized to allow the wires to rotate. Electrical power and/or communication may also be communicated across the mud motor utilizing wire and coil connections.

Various surface systems also may form a part of the drilling system 20. In the example illustrated, a drilling rig 42 is positioned above the wellbore 26 and a drilling mud system 44 is used in cooperation with the drilling rig. For example, the drilling mud system 44 may be positioned to deliver drilling fluid 46 from a drilling fluid tank 48. The drilling fluid 46 is pumped through appropriate tubing 50 and delivered down through drilling rig 42 and into drill string 24. In many applications, the return flow of drilling fluid flows back up to the surface through an annulus 52 between the drill string 24 and the surrounding wellbore wall (see arrows showing flow down through drill string 24 and up through annulus 52). The drilling system 20 also may comprise a surface control system 54 which may be used to communicate with steerable system 28. The surface control system 54 may communicate with steerable system 28 in various manners. In accordance to at least one embodiment, the surface control system may be connected to the digital valves for example via wired pipe.

Referring in particular to FIGS. 2-4, the bias unit 30 including the control valves 34, i.e. digital mud valves, and the actuators 36 are integrated into the drill bit 32 and/or a tubular sub connected directly to the drill bit to form a steering head 100. Conduit(s) 56 connect the drilling fluid 46 to each of the actuators 36 via digital control valves 34. The steering actuators 36 include pistons and steering pads. The control valves 34 control the porting of the pressurized drilling fluid 46 to the piston arrangement driving the steering pads on the steering head to their extended position. The digital control valves 34 may be solenoid devices opening and closing in response to an electrical pulse or signal. In accordance to aspects of the disclosure, the conventional rotary steering system control unit is removed and the power and processing complexity of the measurement while drilling 40 (MWD) module, see for example FIGS. 2 and 4, or of the drilling mechanics module 41 (DMM), see for example FIG. 3, is used to power and sequence the opening and closing of the digital control valves and thereby operate the steering actuators 36. MWD and drilling mechanics modules are illustrated and described as non-limiting examples of the processing systems 62 and power that may be utilized to power and control the steering head based bias unit. The valves may also provide an exhaust pathway to the annulus when the pressurized drilling mud to the valves is curtailed.

In FIGS. 2 and 4 the source of the timing and electrical energy comes for example from an electrical source 64 via an electrical connection 58 to the digital valves 34. The electrical source 64 may be considered a portion of the MWD 40 module. FIG. 2 illustrates the MWD 40 positioned close, i.e., adjacent to the steering head 100, however, MWD 40 may be separated from the steering head 100 for example by a mud motor 37 (e.g., FIG. 4) or other system. MWD 40 includes the sensors 60, processor 62, and power source 64 that is required to control and operate the bias unit 30 (valves and actuators) integrated with the drill bit 32. The steering process needs a sense of direction and this can come from the MWD's direction and inclination (D&I) sensors 60. The MWD 40 needs to be in communication with the surface for example via the telemetry system 68, which may be part of the MWD as is traditional, for example, and without limitation, via a siren pulser or in communication with a remote pressure pulser. The MWD knows the current orientation of drilling and can be told the new set point orientation or curvature for steering from the surface. The MWD can also measure toolface in real time and this is required to time the phase and duration of the on/off commands to the digital actuators.

In FIG. 3 the source of the timing and electrical energy comes from the DMM 41 via an electrical connection 58 to the digital control valves 34 integrated in the steering head 100. The DMM 41 may supply the power from its on board batteries 64 or from a connected powered subsystem, e.g., turbine, somewhere above in the drill string, see e.g. connection 66. DMM 41 is particularly well suited for this function in that it contains all the sensors 60, processor 62, information and power 64 services required. The steering process needs a sense of direction and this comes from D&I sensors in the DMM. The DMM needs to be connected through to other systems that are in communication with the surface, for example via a telemetry system for example located with the MWD. Either way it knows the current orientation of drilling and can be told the new set point orientation or curvature for steering from the surface. The DMM can also measure toolface in real time and this is required to time the phase and duration of the on/off commands to the digital control valves 34 and steering actuators 36. Furthermore the DMM measures drilling loads and torques and can therefore be used in a curvature feedback loop to improve the systems curvature response. The DMM also measures internal and external pressure and can therefore calculate pad force. By modulating the duration of the pad open/close time a measure of force control can be introduced at the steering actuators 36.

The DMM 41 may also be equipped with a caliper, e.g., electronic or ultrasonic, and as an extension of a flight management sensor fusion role that the DMM is able to perform within the total drilling control system. This will make dogleg control even better as the short wave undulation of tortuosity will be made visible and suitable corrective measures introduced. Also, the abrasion effects of the pads on the borehole, its opening up of the hole and consequent loss of dogleg will become visible and open to better remedial steps than are available today through improved control over the pad forces. In accordance to aspects of the disclosure, the DMM may effectively become the heart of the steerable drilling system replacing the traditional MWD and RSS.

In accordance with at least one embodiment, the DMM 41 and MWD 44 are separated from the bias unit 30 portion of the steerable drilling system for example with another collar or physical system between the DMM and MWD and the bias unit, e.g. a drilling mud motor. The same functionality is provided and available except that there is a long connection from the DMM and/or MWD through the intermediate tool. The digital valves 34 may be controlled via an electrical connection, e.g. wired pipe, to another part of the BHA, drill string or directly from the surface. In accordance to at least one embodiment, the system is a networked system where some or all of the BHA tools are connected to a power and communication system. Under these conditions the steering head 100 would receive the power and control form the network under the control of a system master which may be resident in the MWD, DMM tool or another tool of the requisite measurement capability.

Upon torqueing up the steering head 100 with the drill string 24 the angular orientation between datums would be random or at least difficult to define with any precision in advance. However, the alignment between the steering actuator 36 positions on the steering head 100 and the MWD 40 and the DMM 41 measurement systems should be determined within an acceptable tolerance level, for example better than 5 degrees, in order that the correct steering actuators 36 are activated at the correct time. Where the steering head system contains a measurement of toolface, i.e. on bit sensors 60, then the digital set-point of toolface is all that is required; the alignment between the steering head sensors, e.g., magnetometer and accelerometers, and the steering actuators would be defined, measured, and/or set during assembly and testing. In the case where no toolface measurement is resident within the steering head then the alignment can be determined by measuring the angular offset between a datum mark on the steering head (e.g., the first section 102) and a datum mark on the MWD and/or DMM collar 38 and this information transmitted to the MWD and/or DMM by telemetry as the toolface during the running in hole process. In accordance to one or more embodiments, a first connector (e.g., male-connector) from the MWD 40 or DMM 41 could contain an indexing feature be it mechanical, capacitive, inductive, magnetic or optical in form that is read by the second connector (e.g., female connector) on the steering head system to determine the offset. In accordance to some embodiments, the relative angular offset can be determined implicitly for example by a short trial steering period where the offset is determined by the direction in which the hole is propagated, as measured by the MWD and/or the DMM. In accordance to some embodiments, as part of the running in hole process, a datum actuator is cycled at a defined frequency as the steering head is rotated into and touching the borehole wall, the motion sensed by the MWD and/or DMM as the actuator flutters against the borehole is monitored to determine the relative position of the datum actuator. This may be a crude estimate of offset, but will provide a nominal offset for the previous implicit steering response approach, so that steering will generally be in the right direction.

Because the MWD and DMM are making measurements all the time they can determine the phase of drilling operation and can instruct the digital valves 34 to shut off the drilling fluid supply to the steering actuators 36 thus preserving life. For example, when in the neutral (drilling straight ahead) steering mode the MWD and DMM can periodically switch off the drilling fluid supply to the steering actuators thus preserving actuator life that cannot easily be done with a single axis rotary valve system.

Due to their superior measurements, the MWD, DMM and surface systems can determine the changes in toolface offset that are continually occurring while drilling through different formations and under varying drilling conditions and alter the phasing of the toolface commands to the bit-system in compensation. On a shorter times scale, sub bit rotation periods, the MWD, DMM and surface systems can alter the "on" duration of the digital valves 34 thereby altering the integrated force effectiveness of the steering actuators. By such means a measure of force control is introduced to the steering action rather than a fixed angular duration push force. This can be of utility for soft formation drilling where it is not desired to excavate too much of the borehole wall with the steering pads.

Because a digital connection exists between the steering head 100 and the more intelligent machines like the MWD 40, DMM 41, and surface control system 54 measurements of other quantities in the steering head can be relayed for processing and action that lead to a modification of the digital valve steering behavior, i.e., an information loop back to the steering head via an external system rather than all coming directly from an internal system. For example temperature measurements at the steering head can be relayed and the operation of the steering actuators may be altered when the steering head temperature is excessive for example to preserve seal life. Similarly, bit vibration may be detected and the steering actuator firing sequence may be altered to dampen the vibrations.

In accordance to an embodiment the digital valve system, e.g., bias unit 30, may be utilized as an MWD mud pulse telemetry system. The flow rate of the drilling fluid diverted to the steering actuators 36 is relatively high, e.g. 20 to 30 gallons per minute (gpm) per actuator, which is effectively leaked to the annulus. At these flow rates a pressure pulse at the bit is generated on the order of 100 psi. By modulating this pressure pulse information can be encoded on the wave form for decoding elsewhere along the drill string and/or at the surface. The bias unit 30 may be utilized to transmit information off of the bit, such as pad force, pad stroke and other drilling parameters. Utilizing the bias unit 30 for mud pulse telemetry can allow for limiting the cost, length and complexity of the MWD modulator.

Because the digital valves 34 are resident with the bit, i.e. the steering head 100, it is easier to remove, refurbish and/or replace the digital valves and actuators 36 locally, for example at the drilling rig or at a shop in the drilling region. The debris filter in the bias unit that screens particles that may jam the digital valves and actuators may be located at the steering head and thus easier to access as part of the steering head than located in a long, heavy and unwieldy collar. It is easier to flush the steering system of debris between runs where the system is located in the steering head as opposed to being located in a long collar. The bit system functionality can be tested at the drilling site before assembly into the drill string 24. A test bench mimicking the MWD and DMM services can be an effective approach to system test and fault find.

The disclosed steering system provides enhanced fault tolerance. As the digital valves 34 act independently the system is more reliable than conventional single axis rotary valve systems. If any one of the digital valves 34 fails the remaining digital valves and corresponding actuators 36 can continue to steer the wellbore, albeit at a reduced efficiency. Similarly, if a steering actuator 36 fails (e.g., blown seal, wash out) the corresponding digital valve 34 can be closed to shut off the supply of drilling fluid so that a complete washout does not occur.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for propagating a borehole in a desired direction, comprising:

operating a bias unit by controlling first, second, and third digital valves to actuate first, second, and third steering actuators;

applying a first force and timing to the first, second, and third steering actuators;

measuring a distance to a borehole wall;

measuring a direction or an inclination; and modulating the first force and timing to a second force and timing of the first, second, and third steering actuators based on the measured distance to the borehole wall and in response to the measured direction or inclination.

2. The method of claim 1, further comprising communicating information from the bias unit by operating at least one of the first, second, and third digital valves as a mud pulse telemetry system with a pressure pulse of approximately 100 psi.

3. The method of claim 1, wherein bit vibration is detected and an actuation sequence of the first, second, and third actuators is modulated to dampen the detected vibration.

4. The method of claim 1, further comprising causing the first, second, and third digital valves to periodically actuate and deactuate the corresponding first, second, and third steering actuators when drilling straight ahead.

5. The method of claim 1, an actuator flow rate of a pressurized drilling fluid across at least one of the first, second, and third actuators being between 20 and 30 gallons per minute (gpm) per actuator.

6. The method of claim 1, wherein modulating the first force and timing to a second force and timing includes changing a duration of the timing of actuation of the first, second, and third actuators.

7. The method of claim 1, further comprising rotating an MWD independently of the bias unit.

8. The method of claim 7, further comprising transmitting information between the MWD and the bias unit with a rotary electrical connection.

9. The method of claim 1, wherein measuring the distance to the borehole wall is accomplished with a caliper sensor.

10. A method for propagating a borehole in a desired direction, comprising:

selectively opening first, second, and third digital valves with a first timing;

flowing fluid from the first, second, and third digital valves to corresponding first, second, and third actuators;

actuating the first, second, and third actuators with a first force and the first timing based on the opening of the first, second, and third digital valves;

measuring a direction or an inclination;

measuring a distance to a borehole wall;

modulating the opening of the first, second, and third digital valves with the first timing to opening the first, second, and third digital valves with a second timing based on the measured distance to the borehole wall and based on the measured direction or inclination; and modulating actuating the first, second, and third actuators with the first force to actuating the first, second, and third actuators with a second force and the second timing based on the measured distance to the borehole wall and based on the measured direction or inclination.

11. The method of claim 10, wherein flowing fluid includes flowing the fluid from a drill string.

12. The method of claim 10, wherein selectively opening the first, second, and third digital valves includes opening and closing solenoid valves in response to an electrical signal.

13. The method of claim 10, further comprising flowing fluid from the first, second, and third actuators to an annulus through an exhaust pathway.

14. The method of claim 10, further comprising applying a curvature feedback loop based on measuring the direction or the inclination.

15. The method of claim 10, wherein measuring the distance to the borehole wall is accomplished with a caliper sensor.

16. The method of claim 10, further comprising closing one of the first, second, and third digital valves in response to the corresponding first, second, and third actuator failing.

17. A bias unit, comprising:

first, second, and third digital valves, the first, second, and third digital valves including only a first position and a second position;

a sensor configured to measure a distance to a borehole wall;

first, second, and third actuators connected to the first, second, and third digital valves with corresponding first, second, and third conduits; and a control unit configured to change a force and timing of actuation of the first, second, and third digital valves based on the distance measured to the borehole wall and based on azimuth and inclination information.

18. The bias unit of claim 17, further comprising at least one additional sensor.

19. The bias unit of claim 18, wherein the at least one additional sensor is configured to measure the azimuth and inclination information.

20. The bias unit of claim 17, wherein the is caliper sensor.

* * * * *